US005680813A

United States Patent [19]

Schwede

[11] Patent Number: 5,680,813

[45] Date of Patent: Oct. 28, 1997

[54] APPARATUS FOR THE LOOPING OF A PRODUCT STACK BY MEANS OF A LOOPING STRIP

[75] Inventor: Roland Schwede, Goldkronach, Germany

[73] Assignee: SMB Schwede Maschinenbau GMBH, Germany

[21] Appl. No.: 591,834

[22] Filed: Jan. 25, 1996

[30] Foreign Application Priority Data

Feb. 1, 1995 [DE] Germany ..... 195 03 112.1

[51] Int. Cl.[6] ..... B65B 13/06

[52] U.S. Cl. ..... 100/26; 53/589; 226/97

[58] Field of Search ..... 100/25, 26; 53/589; 226/97

[56] References Cited

U.S. PATENT DOCUMENTS

| | | | |
|---|---|---|---|
| 2,913,270 | 11/1959 | Sachsenröder, Sr. et al. | 100/26 |
| 3,831,512 | 8/1974 | Johnson | 100/26 |
| 3,977,314 | 8/1976 | Tanaka | 100/4 |
| 4,655,873 | 4/1987 | Oly | 100/26 |
| 5,078,057 | 1/1992 | Pearson | 100/25 |
| 5,168,686 | 12/1992 | Guttinger | 100/25 |

FOREIGN PATENT DOCUMENTS

| | | | |
|---|---|---|---|
| 0413210 | 2/1991 | European Pat. Off. . | |
| 2557536 | 7/1985 | France | 100/26 |
| 1153318 | 8/1963 | Germany . | |
| 1174688 | 7/1964 | Germany . | |
| 3303956 | 8/1984 | Germany . | |
| 4100276 | 7/1991 | Germany . | |
| 4230730 | 3/1994 | Germany . | |
| 4-114819 | 4/1992 | Japan | 100/26 |
| 2047194 | 11/1980 | United Kingdom . | |

OTHER PUBLICATIONS

EPO search report for EP 96100809.1.

*Primary Examiner*—Stephen F. Gerrity
*Attorney, Agent, or Firm*—Laff, Whitesel, Conte & Saret, Ltd.

[57] ABSTRACT

A looping apparatus for the looping of a product stack with a looping strip. A table is provided so that the product stack can be driven into the looping apparatus and out of it by a conveying device. Further, a strip guide is provided on the table so that the looping strip can be slung as a loose loop around the product stack. An insertion and withdrawal arrangement serves to insert the looping strip and tighten it around the product stack. A connecting arrangement in the form of a welding head fixes the loop of strip that tautly wraps the product stack. The strip guide has mechanically working guide passage sections and, above the table, at least one free distance in air, across which the looping strip is guided when inserted into the strip guide.

11 Claims, 3 Drawing Sheets

APPARATUS FOR THE LOOPING OF A PRODUCT STACK BY MEANS OF A LOOPING STRIP

BACKGROUND OF THE INVENTION

1. Field of the Invention

The invention relates to an apparatus for the looping of a product stack by means of a looping strip in particular of thermoplastic material comprising a table, on which the product stack can be driven into the looping apparatus and out of it by means of a conveying device, a strip guide on the table, by means of which the looping strip can be slung as a loose loop around the product stack, an insertion and withdrawal arrangement for inserting the looping strip into the strip guide and for tightening the looping strip round the product stack, and a connecting arrangement, in particular a welding arrangement, for fixing the loop of strip that tautly wraps the product stack.

2. Background Art

A looping device of the generic type is known from DE 33 03 956 A1. It has a table, on which the product stack can be moved into, or removed from, the looping device in a conveying direction by means of a conveying device in the form of a conveyor belt or a roller conveyor. Further, provision is made for a strip guide on the table, by means of which the looping strip can be guided as a loose loop around the product stack. A strip guiding frame is provided to this end, in which a strip passage is formed, receiving the looping strip.

By means of an insertion and withdrawal arrangement, the looping strip, as a rule of thermoplastic material, is inserted into the strip passage of the strip guide and then tightened round the product stack. A connecting arrangement, in particular a welding head, fixes the loop tightened around the product stack in particular by welding the overlapping ends of the looping strip, and severs the strip from the strip supply.

For the lengthwise looping of a product stack, the construction explained above of the strip guide is accompanied with problems. Contrary to transverse looping, during which the product stack can be inserted unimpeded into the opening of the strip guiding frame which is at right angles and vertical to the conveying direction, the strip guiding frame obstructs the conveying direction of the product stack for longitudinal looping. In this regard, there must be the possibility that the vertical legs, crossing the conveying path, of the strip guiding frame can be pivoted out of the way or moved aside, as specified by DE 33 03 956 A1. This is accompanied with considerable constructional requirements. Moreover, the attainable cycle time and thus the capacity of the looping device is restricted considerably by the pivotable or displaceable frame legs, as the closing motion of the movable elements of the strip guiding frame can be initiated only when the conveying path in the area of intersection with these movable parts is free from the product stack.

The mentioned document teaches a possible approach to the solution of these problems, i.e. the arrangement, diagonal to the conveying path of the product stack, of the two intersecting strip guiding frames for transverse and longitudinal looping. However, for being looped, the product stack itself has to be rotated, which is again accompanied with additional constructional requirements. Moreover, the product stack can be affected by the rotation, for instance a stack of newspapers that has not yet been looped may become misaligned or may even collapse.

Further approaches to solving the above-mentioned problems can be taken from U.S. Pat. No. 5,078,057 and DE 42 30 730 A1. In these longitudinal looping machines, the strip guiding frame is warped in such a way that the vertical sections of the frame are disposed outside of the conveying path and do not interfere. However, this strip guiding frame will need a relatively complicated strip guiding characteristic for the strip to be moved from the warped condition within the strip guiding frame into its position tightened round the product stack. Moreover, the warped strip guiding frames are very complicated to manufacture.

SUMMARY OF THE INVENTION

It is the object of the invention to further develop a looping apparatus of the generic type with a view to the strip guide such that interfering frame members of the strip guide, for instance frame members obstructing the conveying path of the product stack, are avoided.

This object is attained by a basic constructional concept for a strip guide, according to which it is provided that, apart from guide passage sections in which the looping strip is mechanically guided during insertion as is conventional, the strip guide comprises at least one free distance in air above the table, across which the looping strip is guided during insertion into the strip guide.

Based on this concept, in the strip guide of a looping apparatus, the guide passage section can be replaced by a free distance in air, whenever and whysoever obstruction is caused by a mechanically working guide passage section, the looping strip being guided across this distance in air without any mechanical aid when it is inserted into the strip guide.

In a longitudinal looping machine, the conveying path is perfectly free owing to this design of the looping apparatus, there being no need of removing any frame members from the conveying path in order for the product stack to be driven into the looping position and out of it. Rather, the looping strip is virtually "shot" across the free distance in air.

So as to ensure straight guidance of the strip across the distance in air, compressed air can be used to aid in the guidance of the looping strip across the at least one free distance in air in keeping with the preferred embodiment of the invention. Owing to this use of compressed air, an air current surrounds the strip along the free distance in air, stabilizing the strip against deflection.

The compressed-air nozzle arrangement provided according to a further preferred embodiment produces a jet of compressed air, which flows along the respective free distance in air, pneumatically guiding the looping strip on this distance. The nozzle arrangement preferably comprises two compressed-air nozzles disposed one beside the other, between which the looping strip is piloted, its flat sides turned towards the nozzles; it may also be an annular compressed-air nozzle.

For the impeccable transfer of the looping strip from the free distance in air into a subsequent guide passage section, provision is made according to another preferred embodiment for a catching arrangement for the end of the strip leading during insertion, this arrangement preferably being an inlet hopper.

The additional strip driving devices provided according to further preferred embodiments in the inlet portion of the guide passage sections ensure the troublefree looping of the product stack by the strip. The additional strip driving devices help in the insertion of the leading end of the looping strip from the free distance in air into the subsequent guide passage section.

The invention preferably provides for another technical measure in a looping apparatus according to the invention, aiming at supporting the straight and accurate "shooting" of the looping strip across the at least one free distance in air. It is provided to produce a straightening effect on the strip by the strip being braked abruptly while its leading end is guided across the at least one free distance in air. For, if the leading end of the strip deviates from a straight trajectory during its being "shot over", it is virtually straightened by the "whiplash" braking effect. For braking, the insertion mechanism of the looping apparatus can be stopped short.

The roll arrangement according to another preferred embodiment of the invention for planishing the looping strip constitutes another measure that helps in as straight and accurate as possible a "shooting" of the looping strip across the at least one free distance in air. For, with looping strips in particular of thermoplastic material, a basic problem resides in that these strips are available, and placed into the looping apparatus, in a condition coiled up on a supply roll. As a result of this coiling, the strip tends to bending, which shows for instance in that strip supplied from the coil will roll up again in the direction of winding if left to itself.

In the looping apparatus according to the invention, the mentioned tendency of bending involves the risk that the leading end of the strip will deflect automatically when guided across the at least one free distance in air, which adversely affects the accuracy of aim.

So as to prevent this effect, the invention provides for a roll arrangement, through which the looping strip is guided and subjected to alternating senses of curvature. After passing through this roll arrangement, a looping strip, if left to itself, would rest plane on a base plate, not exhibiting any tendency towards rolling up. Consequently, the leading end of a looping strip thus treated does not exhibit any deflection tendency.

Further features, details and advantages of the invention will become apparent from the ensuing description of an exemplary embodiment of the subject matter of the invention, taken in conjunction with the attached drawing.

DESCRIPTION OF THE PREFERRED EMBODIMENT

Figure 1:
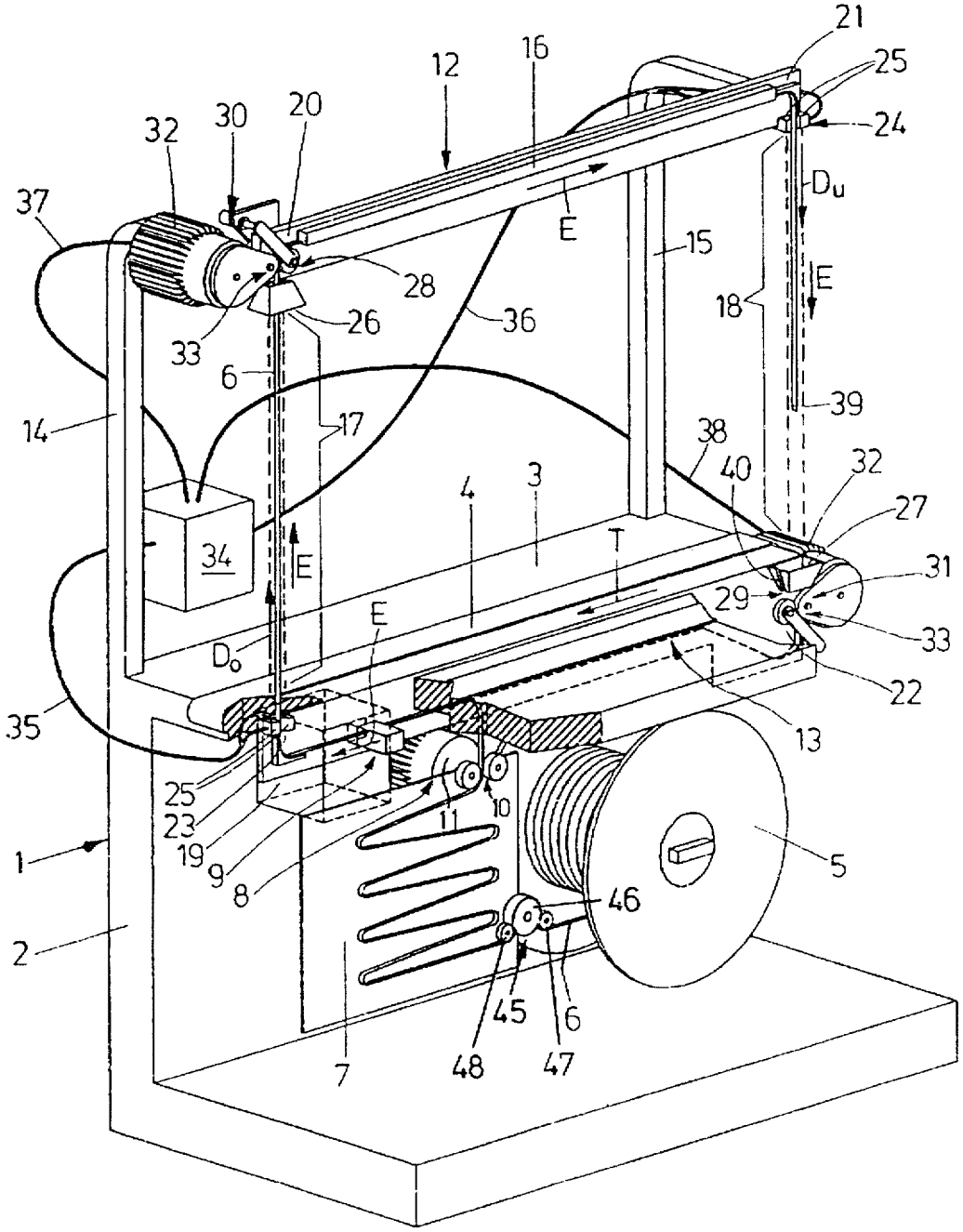
FIGS. 1 to 3 are diagrammatic perspective illustrations, partially broken away, of three different embodiments of a looping apparatus according to the invention.

The looping apparatus of FIG. 1 is a longitudinal looping machine, comprising a table 1 with an underframe 2 and a table area 3. A pair of parallel conveyor belts is arranged on the table area 3, of which the conveyor belt 4 is seen in the drawing. With the aid of these conveyor belts 4, the product stack (not shown)—for instance a stack of newspapers—can be driven in the conveying direction T into the looping apparatus and out of it.

Underneath the table area 3, provision is made for a looping strip 6 supply roll 5, an intermediate store 7, an insertion and withdrawal arrangement 8 as well as a welding head 9. The insertion and withdrawal arrangement 8 consists of a pair of driving rollers 10 driven by an electric motor 11 of a reversible sense of direction. Otherwise, the strip supply comprising the intermediate store 7, the insertion and withdrawal arrangement 8 and the welding head 9 are designed as is conventional with looping apparatuses, no further explanation being necessary regarding their structure and function.

It only remains to be said that, on the way of the strip between the supply roll 5 and the intermediate store 7—i.e. generally upstream of the insertion and withdrawal arrangement 8—a roll arrangement 45 is provided, through which the looping strip 6 is guided. The roll arrangement 45 consists of a central embossing roll 46 and two pressing rolls 47, 48, which cooperate with the latter's circumference for a roll slit to form in each case, and which are disposed on the inlet and outlet side of the roll arrangement 45. As explained, this roll arrangement 45 serves for planishing the looping strip 6. To this end, the strip is guided around the inlet-side pressing roll 47 in a clockwise sense of curvature, then runs on the embossing roll 46 in a counter-clockwise sense of curvature and again on the outlet-side pressing roll 48 in a clockwise sense of curvature. These alternating senses of curvature neutralize any tendencies of the looping strip 6 to bend that might result from the coiling.

Further, in the looping apparatus, provision is made for a strip guide designated in its entirety by 12, by means of which the looping strip 6 can be slung as a loose loop vertical and parallel to the conveying direction T around the product stack moved into the position for looping. The strip guide 12 comprises a lower guide passage section 13, which extends parallel to the conveying direction T and is located underneath the table area 3 in the machine table 1. Above the table area 3, an upper guide passage section 16 is disposed on boom-type props 14, 15, which section is parallel to the lower guide passage section 13 and in alignment with the latter in the vertical direction. Both guide passage sections 13, 16 are formed by profiles of U-shaped cross-section, in which proceeds the looping strip 6. During insertion of the looping strip 6, the open side of these profiles is closed by a covering bar, which is removed when the looping strip 6 is withdrawn and tightened and releases the inside of the profile. Such strip guides and opening mechanism are customary for looping apparatuses and need no further explanation.

As a substantial element, the strip guide 12 further comprises a free distance in air 17, 18 of vertical extension (roughly outlined by dashes in the drawing) in each case between the associated ends 19, 20 and 21, 22, respectively, of the lower and the upper guide passage section 13, 16. When inserted in the strip guide 12, the looping strip 6 is guided across these two free distances in air 17, 18 with the aid of compressed air. To this end, each outlet (end 19 and 21, respectively) of the lower and upper guide passage section 13 and 16 is provided with compressed-air nozzle arrangements 23, 24, which produce a compressed-air jet $D_o$ and $D_u$, respectively, passing along the free distance in air 17, 18 in a direction towards the opposite guide passage section 13 and 16. The nozzle arrangements 23, 24 each consist of two compressed-air nozzles 25 disposed one beside the other, between which the looping strip 6 is guided, its flat sides turned towards the nozzles 25.

The compressed-air nozzles 25 of the lower compressed-air nozzle arrangement 23 at the end 19 of the lower guide passage section 13 are arranged underneath the table area 3 and produce a compressed-air jet $D_o$ directed vertically upwards. The two other compressed air nozzles 25 at the end 21 of the upper guide passage section 16 are oriented such that they produce a compressed-air jet $D_u$ directed vertically downwards.

At the end of the two distances in air 17, 18, provision is made for a catching arrangement in the form of a hopper-type catching aperture 26, 27 ensuring the reliable insertion of the leading end of the strip into the respective guide passage section 13, 16. In the inlet portion 28, 29 of the two guide passage sections 13, 16, the hopper member of the catching aperture 26, 27 is followed by an additional strip driving device 30, 31, which has a pair of driving rollers 33 actuated by an electric motor 32. As seen from the attached drawing, the two driving devices 30, 31 are disposed in the portions of deflection at the inlet-side ends 20, 22 of the two guide passage sections 13, 16. This is where—same as on the other ends 19, 21—conventional deflection elements (not shown in detail) are provided, deflecting the looping strip 6 from its horizontal direction within the two guide passage sections 13, 16 towards the vertical distance in air 17, 18.

As further outlined in the drawing, the additional strip driving devices 30, 31 as well as the nozzle arrangements 23, 24 are triggered by a control 34, the nozzle arrangements 23, 24 being connected to a compressed-air supply in usual manner and the admission of compressed air being switched on and off by soilenoid valves. The valves are not shown in the drawing for reasons of clarity. Only the control lines 35, 36 for the valves and the two control lines 37, 38 for the additional strip driving devices 30, 31 are roughly outlined.

The functioning of the looping device must be explained as follows: As soon as a product stack, for instance a stack of newspapers, has been moved into the position for looping on the table 1 with the aid of the conveyor belts 4, the pair of driving rollers 10 of the insertion and withdrawal arrangement 8 is actuated and the looping strip 6 is inserted, from the intermediate store 7, into the lower guide passage section 13 of the strip guide 12, it is passed through the welding held 9 in the direction of insertion E, and, after being deflected at the end 19 of the lower guide passage section 13, enters the distance in air 17. Corresponding triggering will admit compressed air to the nozzle arrangement 23 so that the upward compressed-air jet $D_o$ aids in the looping strip 6 being shot straight across the distance in air 17 and the end, leading upon insertion, of the looping strip 6 is reliably inserted into the catching aperture 26 in the inlet portion 28 of the upper guide passage section 16. The strip driving device 30 had already been set moving so that the leading end of the strip is picked up by the pair of driving rollers 33 and the strip 6 is shot into the upper guide passage section 16. At this time, the admission of compressed air to the nozzle arrangement 23 can be switched off, because the pneumatic guidance of the looping strip 6 across the distance in air 17 is no longer needed, the strand, crossing the distance in air 17, of the looping strip 6 being pulled through the strip driving device 30. After the leading end of the strip has moved along the upper guide passage section 16 with its deflection at the end 21, the looping strip 6 is inserted into the second distance in air 18 which it crosses vertically from the top to the bottom. Prior to the insertion, the nozzle arrangement 24 there disposed had been activated so that the compressed-air jet $D_u$ of downward direction again guides the strip. The attached drawing virtually is a snapshot showing the looping strip 6 with its leading end 39 crossing the distance in air 18. In this connection it must be mentioned that, for supporting the leading end 39 in its straight trajectory across the free distance in air 17 and 18, the looping strip 6 can be retarded for instance by the pair of driving rollers 33 being abruptly braked. This leads to an effect best denoted as a "whiplash effect", as a result of which the leading end 39—if deviating from the imaginary straight line along the free distance in air 17 and 18—will straighten owing to its inertia.

In the course of the insertion operation, the leading end of strip 39 enters the catching aperture 27, the looping strip 6 is taken by the strip driving device 31 and further conveyed into the lower guide passage section 13 until the leading end 39 enters the welding head 9. At this time, the pairs of driving rollers 10, 33 are switched off, the leading end of the strip is retained in the welding head and the pair of driving rollers 10 is set rotating in the opposite direction. Simultaneously, the upper and the lower guide passage sections 13 and 16 are opened and the rollers, directed inwards, of the pairs of driving rollers 33 are pivoted aside. As a result, the looping strip 6 is free to leave the strip guide 12, and can tautly wrap the product stack. The withdrawn strand of the looping strip 6 is placed into the intermediate store 7.

Once the looping strip 6 of thermoplastic material is slung tightly around the product stack, the welding head 9 is activated, welding together the portions of the looping strip that overlap and severing them form the strip supply. Thus, the product stack is looped longitudinally and can be driven out of the looping apparatus in the conveying direction T by means of the conveyor belts 4.

Remains to be completed that the hopper members forming the catching apertures 26, 27 are provided with slots 40 on their inside for the looping strip 6 to pass through when it is withdrawn.

Figure 2:
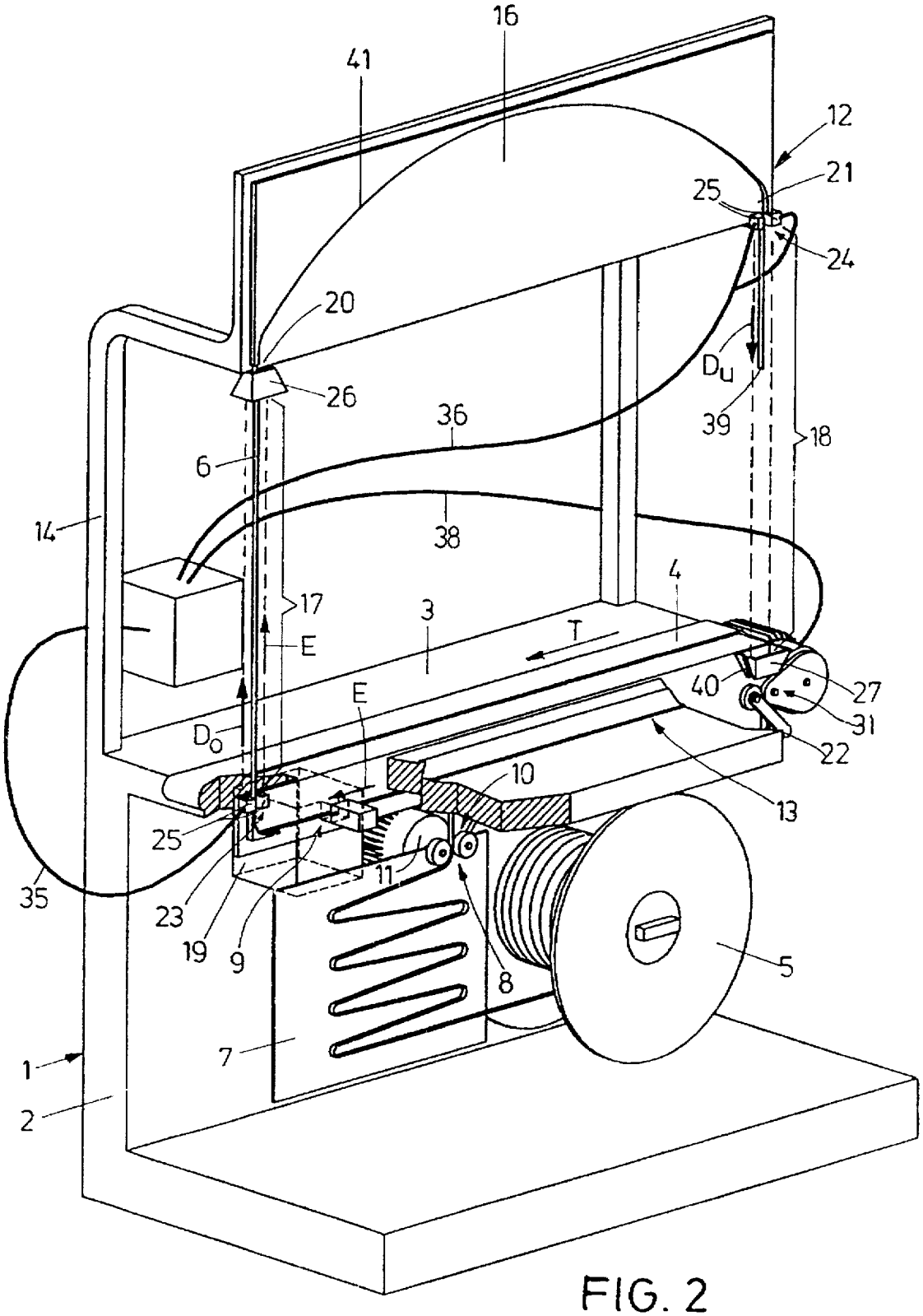

The looping apparatus of FIG. 2 also is a longitudinal looping machine, differing from the embodiment of FIG. 1 only in the design of the upper guide passage section 16. The latter and the lower guide passage section 13 may be in a common vertical plane, but the upper guide passage section 16 forms a flat arch 41 lengthwise, connecting the inlet-side catching aperture 26 with the outlet-side nozzle arrangement 24. Owing to the flat, arched course of the upper guide passage portion 16, the strip driving device 30 can be dispensed with. Rather, by means of the advance of the insertion and withdrawal arrangement 8, the looping strip 6 is moved across the arch 41, at the end of which it passes through the compressed-air nozzle arrangement 24 and enters the second distance in air 18. At the end of this distance in air 18, the looping strip 6 is seized by the strip driving device 31 and moved ahead in the lower guide passage section 13 as far as to the welding head 9. Otherwise, the looping operation takes place in the way described on the basis of FIG. 1. Apart from the differences explained above, the structure of the looping apparatus according to FIG. 2 corresponds to that of FIG. 1 so that identical components have the same reference numerals and reference can be made to FIG. 1.

The looping apparatus of FIG. 3 is again a longitudinal looping machine, the structure of which corresponds to that of the apparatus according to FIG. 1 apart from the differences specified below. Identical components, therefore, again have the same reference numerals.

Figure 3:
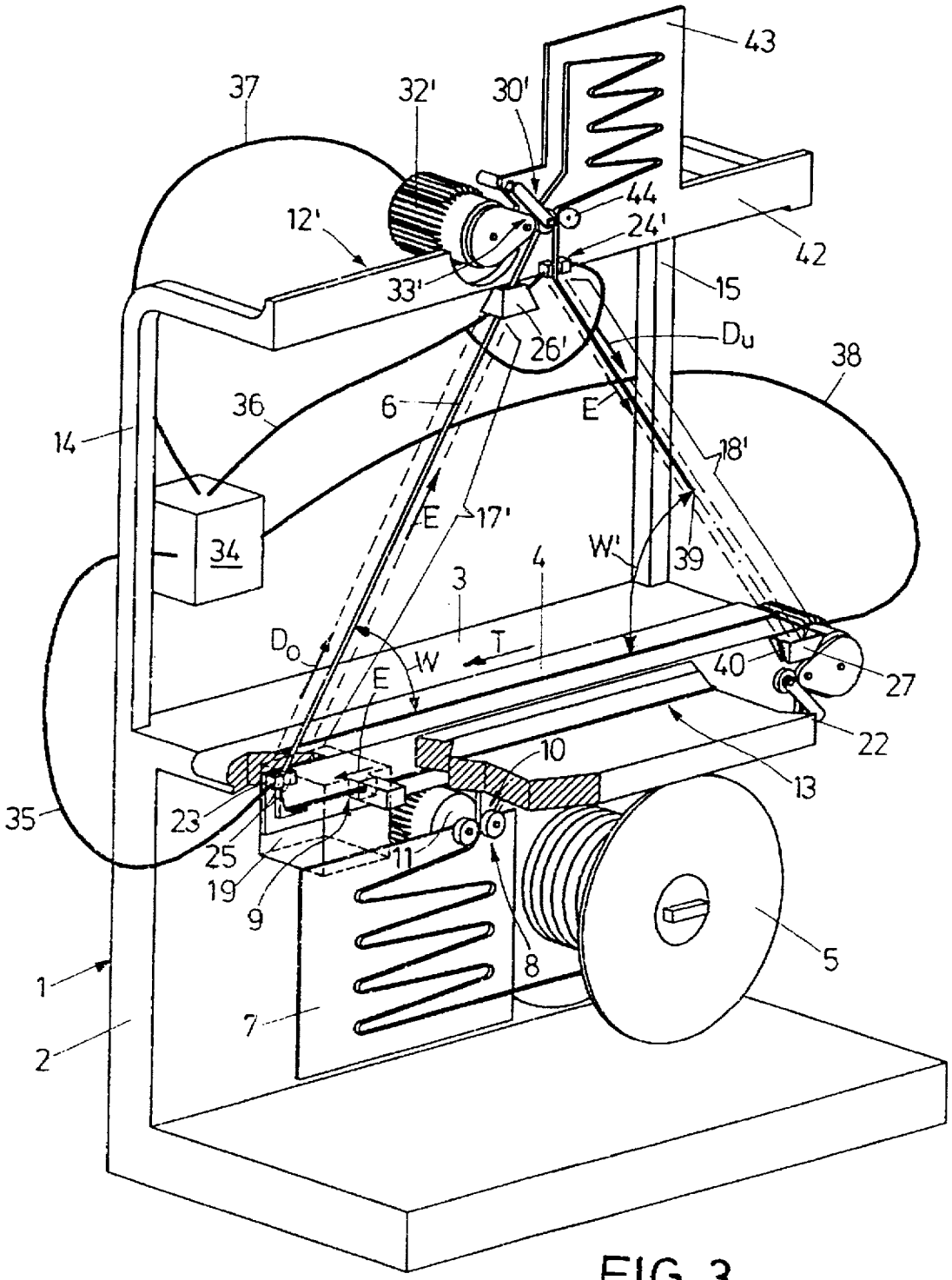

Instead of the upper guide passage section 16, the boom-type props 14, 15 of the longitudinal looping machine of FIG. 3 have a longitudinal brace 42, on which is centrally disposed a hopper-type catching aperture 26' for the looping strip 6. As a result, the catching aperture 26' is disposed centrally above the table 1 in a vertical plane that it has in common with the lower guide passage sectin 13. By the misalignment in the conveying direction T of the catching aperture 26' relative to the compressed-air nozzle arrangement 23, the distance in air 17 does not extend vertically any more, but at an acute angle W in relation to the table 1 in the vertical plane mentioned above.

The catching aperture 26' is followed by a strip driving device 30' as an intermediate drive, which again has an electric motor 32' and a pair of driving rollers 33'. By means of this strip driving device 30', the looping strip 6 is inserted into an intermediate store 43, from where it moves to the compressed-air nozzle arrangement 24' which is directly contiguous to the catching aperture 26' and by means of which the looping strip 6 is shot, again at an acute angle W' to the table 1 in the mentioned vertical plane, across the inclined distance in air 18' in the direction towards the catching aperture 27. By adaptation to the inclined distances in air 17', 18', the nozzle arrangements 23 and 24' are inclined in a manner not shown in detail.

As seen in FIG. 3, the strip guide 12' of the embodiment according to FIG. 3 comprises the lower guide passage section 13 mentioned above disposed in the table 1 as well as the two free distances in air 17', 18' which extend upwards from each end of the lower guide passage section 13 and which, by their inclined arrangement, guide the looping strip such that the loose loop formed during the insertion of the looping strip essentially has the shape of a triangle of vertical arrangement.

The strip driving device 30' is further provided with an additional roller 44, to which the electric motor 32' can be switched so that the intermediate drive thus formed works to the side of the inlet as well as to the side of the outlet.

The functioning of the looping apparatus according to FIG. 3 can be compared to that of FIG. 1, renewed explanation not being necessary. Furthermore, the looping apparatuses of FIGS. 2 and 3 may also be provided with a roll arrangement 45 as it is illustrated in FIG. 1.

What is claimed is:

1. An apparatus for the looping of a product stack by means of a looping strip comprising:

a table (1), on which the product stack can be driven into the looping apparatus and out of the looping apparatus by means of a conveying device (4), a strip guide (12) on the table (1), by means of which the looping strip (6) can be slung as a loose loop around the product stack, an insertion and withdrawal arrangement (8) for inserting the looping strip (6) into the strip guide (12) and for tightening the looping strip (6) round the product stack, and a connecting arrangement (9) for fixing the loop of strip that tautly wraps the product stack, wherein the strip guide (12) comprises guide passage sections (13, 16), in which the looping strip (6), when inserted, is mechanically guided and at least one free distance in air (17, 18, 17', 18') above the table (1), across which the looping strip (6) is guided when inserted into the strip guide (12) wherein the looping strip (6), when guided across the at least one free distance in air (17, 18, 17', 18') is supported by compressed air.

2. A looping apparatus according to claim 1 comprising at least one compressed-air nozzle arrangement (23, 24, 24') at the beginning of the at least one free distance in air (17, 18, 17', 18') for the production of a compressed-air-jet ($D_o$, $D_u$) flowing along the free distance in air (17, 18, 17', 18') in a direction of insertion (E).

3. A looping apparatus according to claim 2, wherein each of the at least one nozzle arrangement (23, 24, 24') consists of two compressed-air nozzles (25) one disposed beside the other, between which the looping strip (6) is guided with flat sides of the looping strip (6) turned towards the nozzles (25).

4. A looping apparatus according to claim 2, wherein each of the at least one nozzle arrangement has an annular compressed-air nozzle, through the annular gap of which the looping strip (6) can be guided.

5. An apparatus for the looping of a product stack by means of a looping strip comprising:

a table (1), on which the product stack can be driven into the looping apparatus and out of it by means of a conveying device (4), a strip guide (12) on the table (1), by means of which the looping strip (6) can be slung as a loose loop around the product stack, an insertion and withdrawal arrangement (8) for inserting the lopping strip (6) into the strip guide (12) and for tightening the lopping strip (6) round the product stack, a connecting arrangement (8) for fixing the loop of strip that tautly wraps the product stack, wherein the strip guide (12) comprises guide passage sections (13, 16), in which the lopping strip (6), when inserted, is mechanically guided and at least one free distance in air (17, 18, 17', 18') above the table (1), across which the looping strip (6) is guided when inserted into the strip guide (12) wherein in an inlet portion (28, 29) of the guide passage sections (13, 16), additional strip driving devices (30, 30', 31 ) are provided as an intermediate drive for the looping strip (6).

6. A looping apparatus according to claim 5, wherein the additional strip driving devices (30, 31) are disposed in the deflection portions at inlet-side ends (20, 22) of a lower and upper guide passage section (13, 16).

7. An apparatus for the looping of a product stack by means of a looping strip comprising:

a table (1), on which the product stack can be driven into the looping apparatus and out of it by means of a conveying device (4), a strip guide (12) on the table (1), by means of which the looping strip (6) can be slung as a loose loop around the product stack, an insertion and withdrawal arrangement (8) for inserting the looping strip (6) into the strip guide (12) and for tightening the looping strip (6) round the product stack, and a connecting arrangement (8) for fixing the loop of strip that tautly wraps the product stack, wherein the strip guide (12) comprises guide passage sections (13, 16), in which the looping strip (6), when inserted, is mechanically guided and at least one free distance in air (17, 18, 17', 18') above the table (1), across which the looping strip (6) is guided when inserted into the strip guide (12), wherein the strip guide (12) comprises, a lower guide passage section (13) in the table (1), an upper guide passage section (16) extending substantially parallel thereto above the table (1), and a free vertical distance in air (17, 18) between the ends (19, 20, 21, 22) of the lower and upper guide passage section (13, 16).

8. An apparatus for the looping of a product stack by means of a looping strip comprising:

a table (1), on which the product stack can be driven into the looping apparatus and out of it by means of a conveying device (4), a strip guide (12) on the table (1), by means of which the looping strip (6) can be slung as a loose loop around the product stack, an insertion and withdrawal arrangement (8) for inserting the looping strip (6) into the strip guide (12) and for tightening the looping strip (6) round the product stack, and a connecting arrangement (8) for fixing the loop of strip that tautly wraps the product stack.

wherein the strip guide (12) comprises guide passage sections (13, 16), in which the looping strip (6), when inserted, is mechanically guided and at least one free distance in air (17, 18, 17', 18') above the table (1), across which the looping strip (6) is guided when inserted into the strip guide (12)

wherein the strip guide (12') comprises, in the table (1), a lower guide passage section (13), at the two ends of which free distances in air (17', 18') extend upwards, which are disposed such that the loose loop of strip formed upon the insertion of the looping strip (6) substantially has the shape of a vertically upright triangle.

9. A looping apparatus according to claim 8, wherein in a deflection portion at an upper vertex of the triangular arrangement of the looping strip (6), provision is made for an intermediate drive (30') working to a side of the inlet as well as to a side of the outlet and having an intermediate strip store (43).

10. An apparatus for the looping of a product stack by means of a looping strip comprising:

a table (1), on which the product stack can be driven into the looping apparatus and out of it by means of a conveying device (4), a strip guide (12) on the table (1), by means of which the looping strip (6) can be slung as a loose loop around the product stack, an insertion and withdrawal arrangement (8) for inserting the looping strip (6) into the strip guide (12) and for tightening the looping strip (6) round the product stack, and a connecting arrangement (8) for fixing the loop of strip that tautly wraps the product stack, wherein the strip guide (12) comprises guide passage sections (13, 16), in which the looping strip (6), when inserted is mechanically guided and at least one free distance in air (17, 18, 17', 18') above the table (1), across which the looping strip (6) is guided when inserted into the strip guide (12), wherein the looping strip (6) can be straightened by abrupt braking when its leading end (39) is guided across the at least one free distance in air (17, 18, 17', 18').

11. An apparatus for the looping of a product stack by means of a looping strip comprising:

a table (1), on which the product stack can be driven into the looping apparatus and out of it by means of a conveying device (4), a strip guide (12) on the table (1), by means of which the looping strip (6) can be slung as a loose loop around the product stack, an insertion and withdrawal arrangement (8) for inserting the looping strip (6) into the strip guide (12) and for tightening the looping strip (6) round the product stack, and a connecting arrangement (8) for fixing the loop of strip that tautly wraps the product stack, wherein the strip guide (12) comprises guide passage sections (13, 16), in which the looping strip (6), when inserted, is mechanically guided and at least one free distance in air (17, 18, 17', 18') above the table (1), across which the looping strip (6) is guided when inserted into the strip guide (12), wherein upstream of the insertion and withdrawal arrangement (8), a roll arrangement (45) is provided for planishing the looping strip (6), which is guided through the roll arrangement (45) in alternating senses of curvature.

* * * * *